US006378713B2

(12) United States Patent
Montgomery

(10) Patent No.: US 6,378,713 B2
(45) Date of Patent: Apr. 30, 2002

(54) SAFETY CLOSURE AND CONTAINER

(75) Inventor: Gary V. Montgomery, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/859,068

(22) Filed: May 16, 2001

Related U.S. Application Data

(63) Continuation of application No. 09/131,631, filed on Aug. 10, 1998.
(60) Provisional application No. 60/075,932, filed on Feb. 25, 1998.

(51) Int. Cl.[7] ..... B65D 55/02

(52) U.S. Cl. ..... 215/222; 220/300; 220/302; 215/332; 215/341; 215/342; 215/344

(58) Field of Search ..... 215/222, 332, 215/341, 342, 343, 344, DIG. 1; 220/293, 298, 300, 302

(56) References Cited

U.S. PATENT DOCUMENTS 3,435,975 A * 4/1969 Weigand ..... 215/214
6,082,565 A * 7/2000 Harrold ..... 215/218

FOREIGN PATENT DOCUMENTS

GB 1302202 * 1/1973 ..... 215/222

* cited by examiner

*Primary Examiner*—Stephen P. Garbe
*Assistant Examiner*—Joseph C. Merek
(74) *Attorney, Agent, or Firm*—John F. Salazar; Middleton Reutlinger

(57) ABSTRACT

A safety closure for use on a container neck portion, providing an end wall and a side wall depending from the end wall. The side wall has at least one lug projecting therefrom near a lower end thereof, which is engageable with at least one lug-receiving recess provided in the container neck portion. A sealing plug depends from the end wall and is sealingly engageable with a dispensing orifice provided in the container neck portion. At least one spring member depends from the end wall and are resiliently engageable with the container neck portion to bias the safety closure away from the container neck portion.

18 Claims, 9 Drawing Sheets

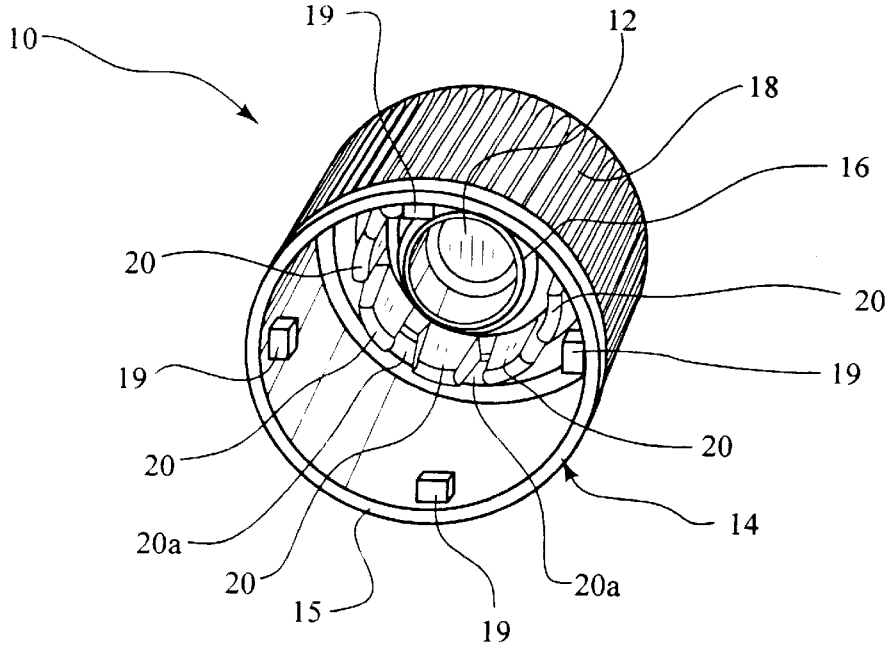
FIG. 1
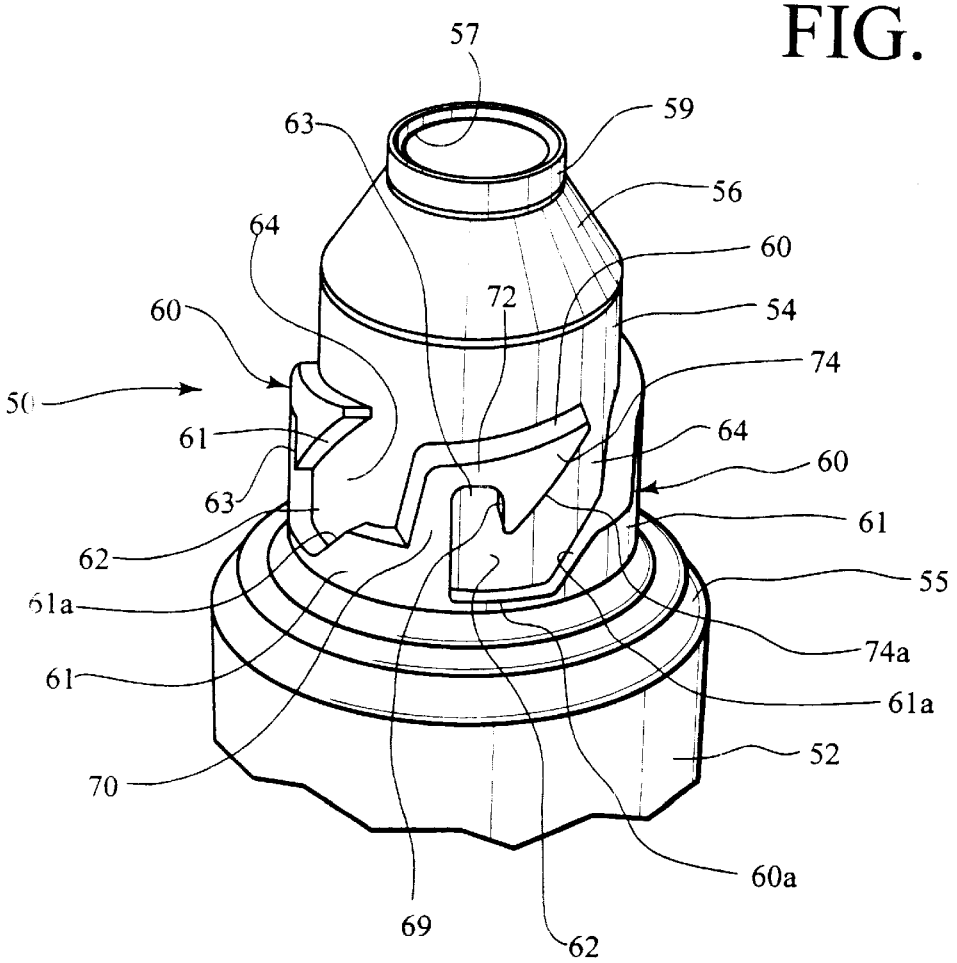

SAFETY CLOSURE AND CONTAINER

CROSS-REFERENCE TO RELATED APPLICATIONS

This application is a continuation of U.S. Utility Application Ser. No. 09/131,631 filed Aug. 10, 1998 which claims priority from U.S. Provisional Patent Application Ser. No. 60/075,932 entitled "Safety Closure and Container" filed on Feb. 25, 1998, said Application being incorporated herein by reference.

BACKGROUND OF THE INVENTION

1. Technical Field of the Invention

The present invention relates to safety closures for use on containers. More particularly, the present invention relates to a safety closure for use on a container, wherein the safety closure and the container are each provided with engageable locking means which cooperate to seal the container and to inhibit access thereto by individuals of tender years.

2. Description of the Related Art

It is well known in the prior art to sealingly affix a safety closure upon the neck portion of a container to prevent unwanted spillage of the contents of the container therefrom. Typically, a gasket liner is positioned within the safety closure which sealingly engages an upper portion of the container neck portion. Alternatively, a sealing plug may be integrally-formed within the safety closure which resiliently engages the upper portion of the container neck portion to define a sealing fit therebetween. It is therefore desirable to provide a safety closure for use on a container neck portion, wherein the safety closure is sealingly affixable to the container neck portion to prevent spillage of the contents of the container therefrom.

It is even further known in the prior art for the safety closure and the container neck portion to each include engageable locking means which cooperate to inhibit removal of the safety closure from the container neck portion by individuals of tender years. It is therefore further desirable to provide a safety closure for use on a container neck portion, wherein the safety closure is sealingly affixable to the container neck portion to prevent spillage of the contents of the container therefrom, and wherein the safety closure and the container each include engageable locking means to inhibit removal of the safety closure from the container neck portion by individuals of tender years.

For example, U.S. Pat. No. 3,951,289 to Landen, and U.S. Pat. No. 5,449,078 to Akers, each teach a safety closure device being affixable to a container neck portion, wherein the safety closure includes a continuous plug which is engageable with the container neck portion to define a sealing fit therebetween. The continuous plug also serves to bias the safety closure outwardly from the container neck portion, thereby cooperating with locking means provided on the safety closure and on the container neck portion to inhibit removal of the safety closure from the container by individuals of tender years. However, it has been observed that, where a common element is used as both biasing means and sealing means, seal integrity is oftentimes breached due to the flexure of the common element which is necessary to provide the bias. Thus, it is further desirable to provide a safety closure for sealingly engaging a container neck portion, wherein the safety closure includes biasing means which are separate and independent from sealing means provided thereby.

SUMMARY OF THE INVENTION

The present invention is for a safety closure for use on a container, wherein the safety closure is provided with separate and independent biasing means and sealing means. The safety closure is provided with at least one lug which engages a bayonet provided on a neck portion of the container and which is biased in a "locked" position on the container neck portion by at least one spring member. The spring member flexes against an outer surface of the container neck portion to provide an upward biasing force to the safety closure, thereby seating the lug into the bayonet and requiring the user to depress the safety closure downwardly against the spring member bias to unseat the lug. The sealing means is preferably an integral plug which is sized to engage an opening in the container neck portion. Flexure of the spring member does not affect the sealing engagement of the plug within the opening.

It is an object of the present invention to provide a safety closure for use on a container neck portion, wherein the safety closure is sealingly affixable to the container neck portion to prevent spillage of the contents of the container therefrom.

It is another object of the present invention to provide a safety closure for use on a container neck portion, wherein the safety closure is sealingly affixable to the container neck portion to prevent spillage of the contents of the container therefrom, and wherein the safety closure and the container each include engageable locking means to inhibit removal of the safety closure from the container neck portion by individuals of tender years.

It is still another object of the present invention to provide a safety closure for sealingly engaging a container neck portion, wherein the safety closure includes biasing means which are separate and independent from sealing means provided thereby.

These and other objects, features and advantages of the present invention will become apparent to those skilled in the art upon reading the ensuing detailed description in conjunction with the drawings and with reference to the appended claims.

A safety closure according to a preferred embodiment of the present invention includes an end wall and a side wall depending from the end wall. The side wall has at least one lug projecting therefrom near a lower end thereof, which is engageable with at least one lug-receiving recess provided in the container neck portion. A sealing plug depends from the end wall and is sealingly engageable with a dispensing orifice provided in the container neck portion. At least one spring member depends from the end wall and is resiliently engageable with the container neck portion to bias the safety closure away from the container neck portion.

BRIEF DESCRIPTION OF THE DRAWINGS

A better understanding of the present invention will be had upon reference to the following description in conjunction with the accompanying drawings in which like numerals refer to like parts, and wherein:

FIG. 1 is a perspective view of a safety closure according to a preferred embodiment of the present invention, shown in spaced relation to a container neck portion according to a preferred embodiment of the present invention;

DETAILED DESCRIPTION OF THE PREFERRED EMBODIMENTS

Figure 2:
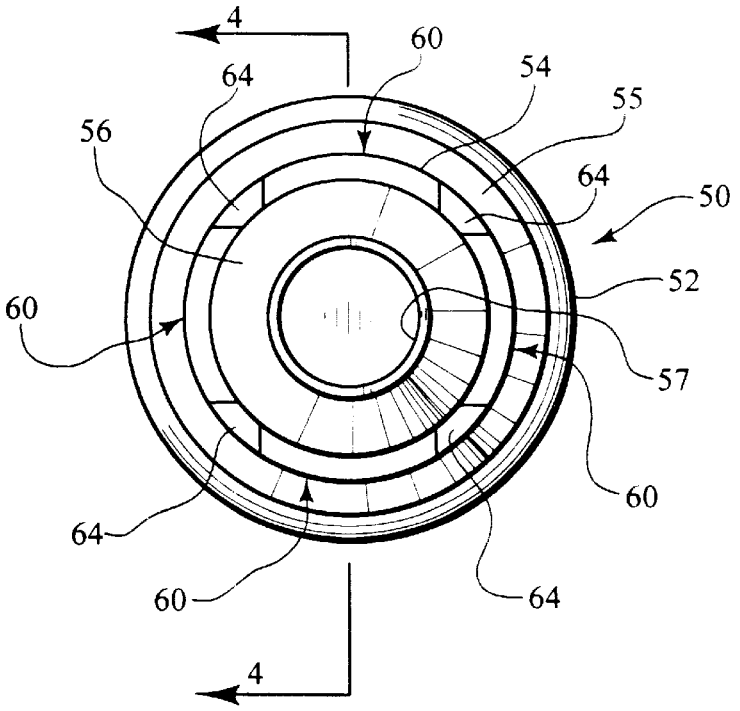
FIG. 2 is a top view of the container neck portion of FIG. 1.
Figure 3:
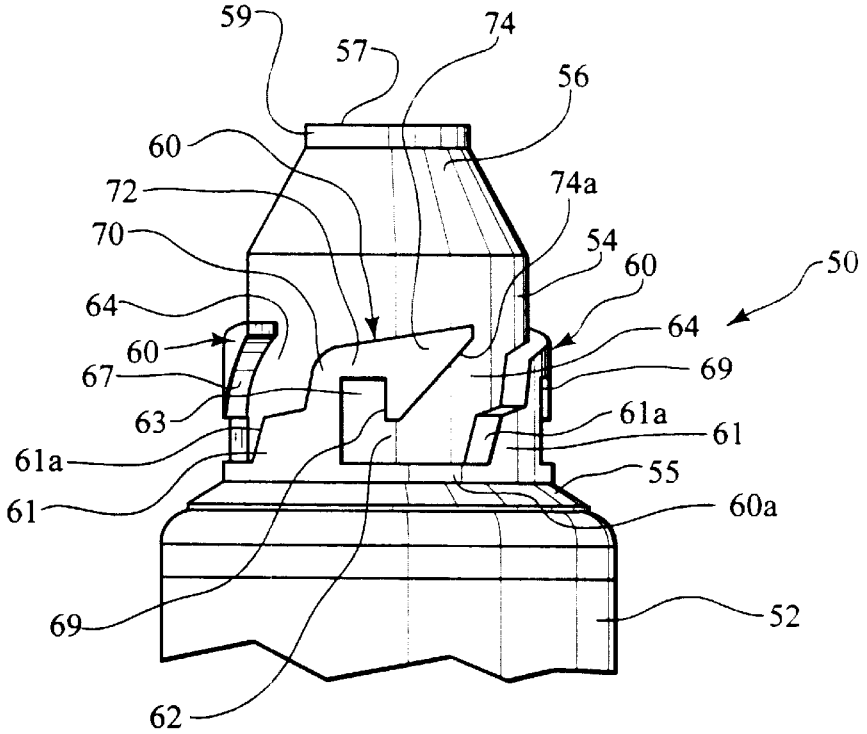
FIG. 3 is a side view of the container neck portion of FIG. 1.
Figure 4:
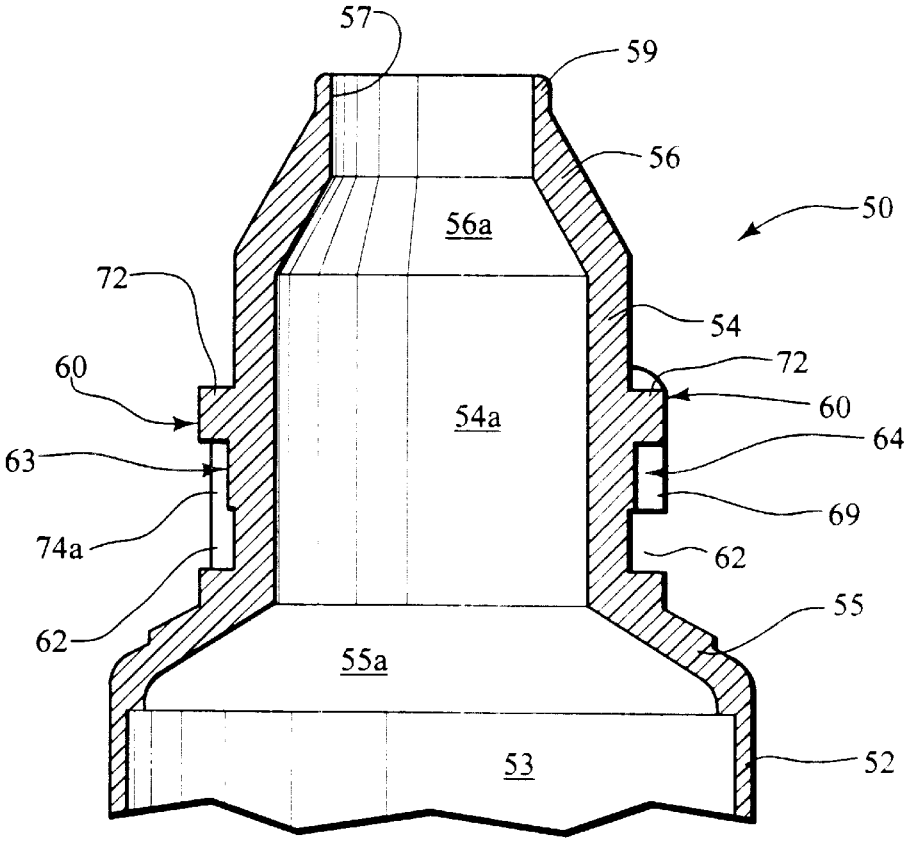
FIG. 4 is a section view of the container neck portion of FIG. 1, shown along section line 4—4 of FIG. 2.
Figure 5:
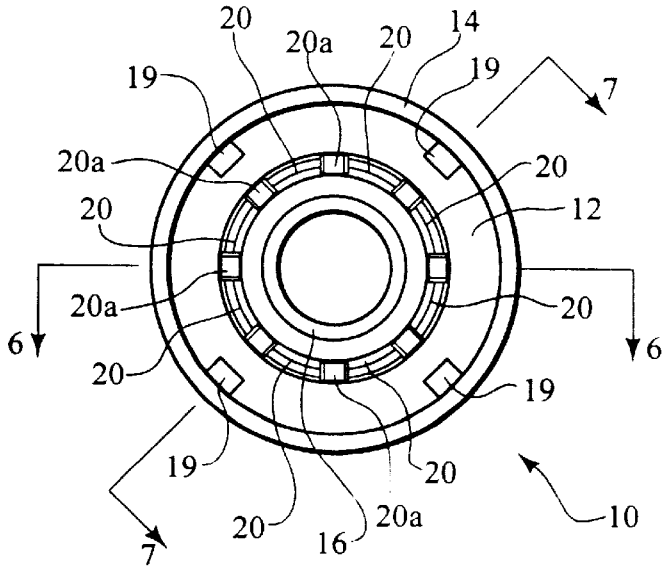
FIG. 5 is a bottom view of the safety closure of FIG. 1.
Figure 6:
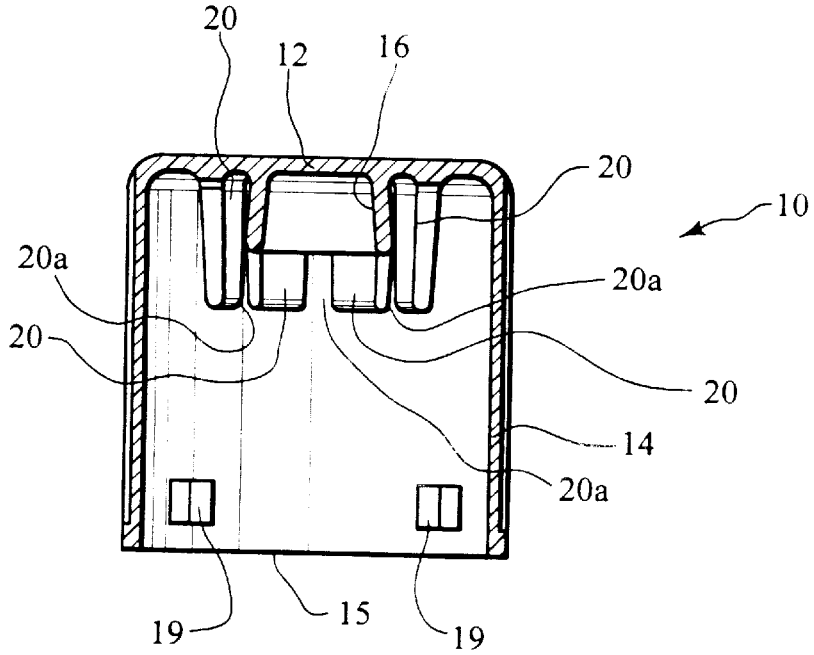
FIG. 6 is a section view of the safety closure of FIG. 1, shown along section line 6—6 of FIG. 5.
Figure 7:
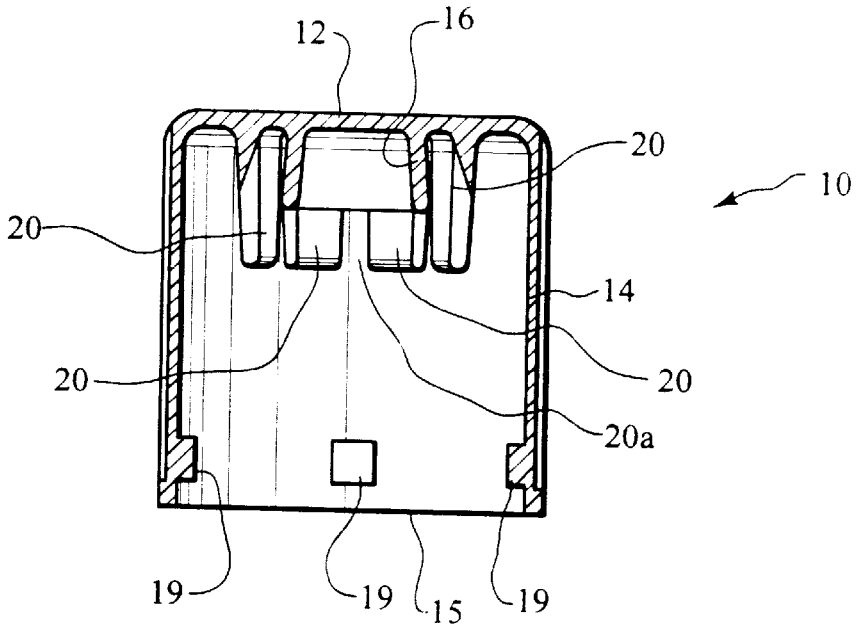
FIG. 7 is a section view of the safety closure of FIG. 1, shown along section line 7—7 of FIG. 5.

With reference to FIGS. 1–4, a container 50 according to a preferred embodiment of the present invention, only an upper portion of which is shown in the Figures, includes a cylindrical body 52 defining a cavity 53 therein for receiving and storing therein a substance, such as, for example, a liquid, dry powder, or a plurality of pills, capsules, tablets or the like. A cylindrical neck portion 54 projects axially upwardly from the body 52 and is connected to the body 52 by a frusto-conical shoulder 55. A frusto-conical camming portion 56 projects inwardly and upwardly from an upper end of the neck portion 54 and terminates in an upturned cylindrical portion 59. The shoulder 55, the neck portion 54 and the camming portion 56 each include a passageway 55*a*, 54*a*, 56*a*, respectively, therethrough, thereby providing communication between the body cavity 53 and a dispensing orifice 57 provided through an upper end of the camming portion upturned cylindrical portion 59 to permit filling and dispensing of the substance to and from within the cavity 53. The container 50 is preferably constructed from any suitable heat-setting, moldable polymer, such as, for example, polyester, polyethylene, polypropylene or the like, and is formed by any suitable process, such as, for example, injection-molding or the like.

The neck portion 54 includes at least one integrally-formed, radially-raised bayonet 60, and preferably, four bayonets 60 annularly spaced equidistantly around an outer perimeter of the neck portion 54, near the shoulder 55 and raised radially outwardly therefrom a preselected distance. The bayonets 60 may be integrally-formed with and connected to one another by an annular band 60*a* raised radially outwardly from the neck portion 54 coextensively with the bayonets 60 along a lower portion thereof near the shoulder 55.

Each bayonet 60 includes an axial upright portion 70 projecting upwardly from the annular band 60*a* away from the body 52 and an annular overhead portion 72 projecting annularly from said upright portion 70 in a backwardly (that is, counter-clockwise, when viewed from above) direction. The overhead portion 72 is spaced from the annular band 60*a* by a preselected distance and terminates in a latch portion 74 projecting downwardly towards the annular band 60*a*. The latch portion 74 is annularly spaced from the upright portion 70 by a preselected distance. The annular band 60*a*, the upright portion 70, the overhead portion 72 and the latch portion 74 are preferably integrally-molded and are raised radially outwardly from the container neck portion 54 by a preselected distance.

The annular band 60*a* cooperates with the overhead portion 72 of each bayonet 60 to define a lower radial recess 62 therebetween. An upwardly stepped portion 61 of the annular band 60*a* projects axially upwardly therefrom towards the overhead portion 72 and is spaced annularly backwardly from the upright portion 70 of each bayonet 60 to define a lug-receiving recess 64 between a lower rail 74*a* of the latch portion 74 and an upper rail 61*a* of the annular band stepped portion 61. Where more than one bayonet 60 is provided on the container neck portion 54, the annular band stepped portion 61 may be integral with the upright portion 70 of each bayonet 60. The lower radial recess 62 communicates with an upper portion of the container neck portion 54 by the lug-receiving recess 64, which is sized to slidingly receive one of the at least one lugs 19 therein. The upright portion 70 of each bayonet 60 cooperates with the overhead portion 72 and with the latch portion 74 thereof to define an upturned recessed portion 63 being surrounded on three sides thereof by the raised bayonet 60 and being in communication with the lower radial recess 62.

With reference to FIG. 1 and FIGS. 5–7, a safety closure 10 for use on the container 50 is of an integral construction and includes an end wall 12, a cylindrical skirt 14 depending downwardly from an outer perimeter of the end wall 12, an outwardly-flared continuous annular plug 16 depending downwardly from an underside surface of the end wall 12, and at least one spring member 20 depending downwardly from the underside surface of the end wall 12 and spaced radially outwardly from the plug 16 a preselected distance. Alternatively, the at least one spring member 20 may project inwardly and downwardly from the closure cylindrical skirt 14. Preferably, eight spring members 20 are provided and are annularly spaced equidistantly outwardly around an outer perimeter of the plug 16, defining narrow annular spaces 20*a* therebetween. The safety closure 10 is preferably constructed from any suitable heat-setting, moldable polymer, such as, for example, polyester, polyethylene, polypropylene or the like, and is formed by any suitable process, such as, for example, injection-molding or the like. An outer surface 18 of the skirt 14 may be provided with axial grooves, knurls, ridges, or other surface texturing to permit easy gripping and rotation of the safety closure 10.

At least one lug 19 is integrally-molded with, and projects radially inwardly from, an inner annular surface of the skirt 14 near a lower end 15 thereof. More particularly, one lug 19 is provided for each of the at least one bayonets 60 provided on the container neck portion 54. Preferably, four lugs 19 are provided and are annularly spaced equidistantly around an outer perimeter of the skirt 14 to fit between the bayonets 60, and more particularly, to fit within the lug-receiving recesses 64 defined by the bayonets 60. Each lug 19 is sized and shaped to be slidingly received within the container bayonet lug-receiving recess 64, the lower recess 62 and the upturned portion 63 of the lower recess 62.

Figure 8:
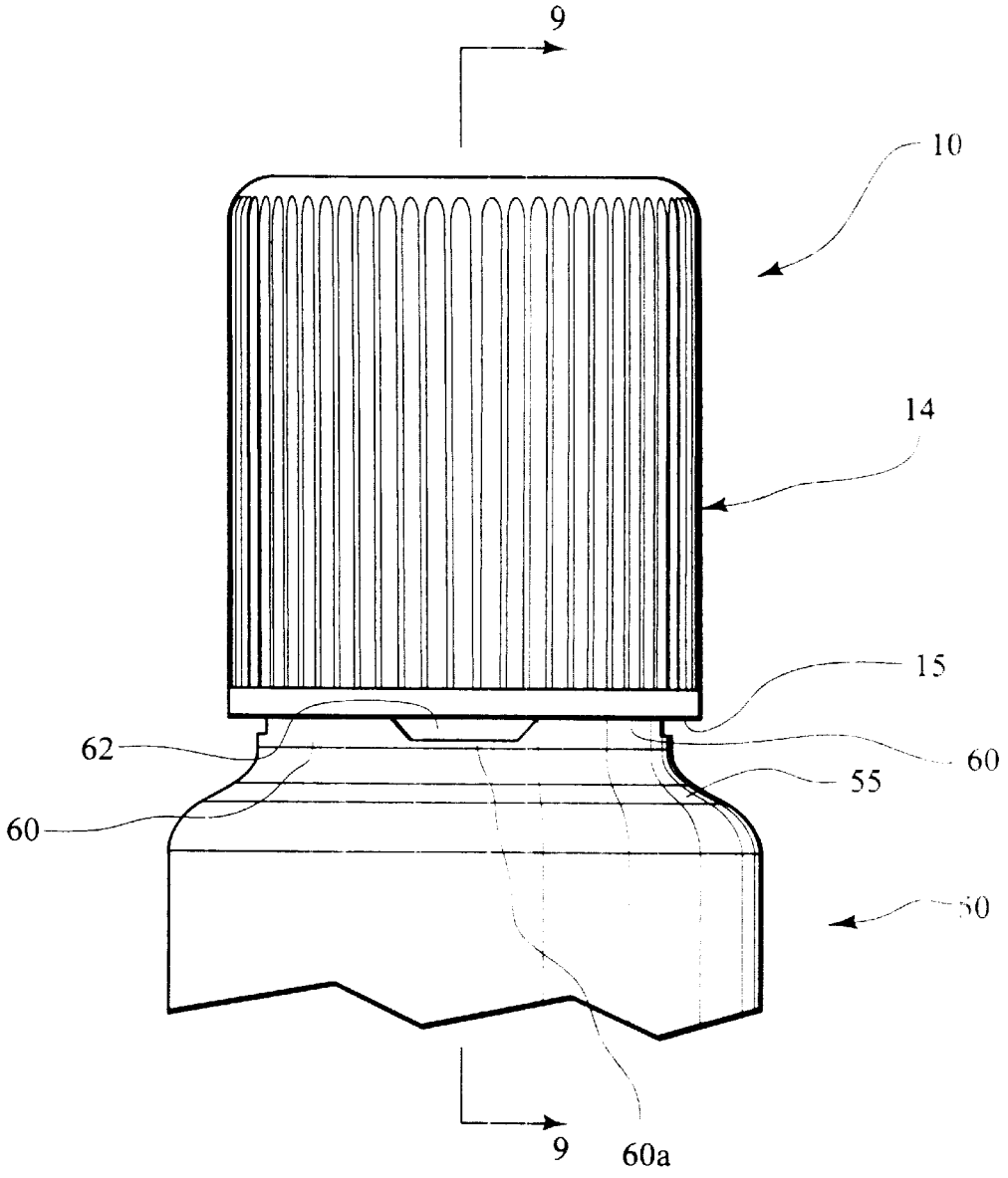
FIG. 8 is a side view of the safety closure of FIG. 1 shown affixed to the container neck portion of FIG. 1.
Figure 9:
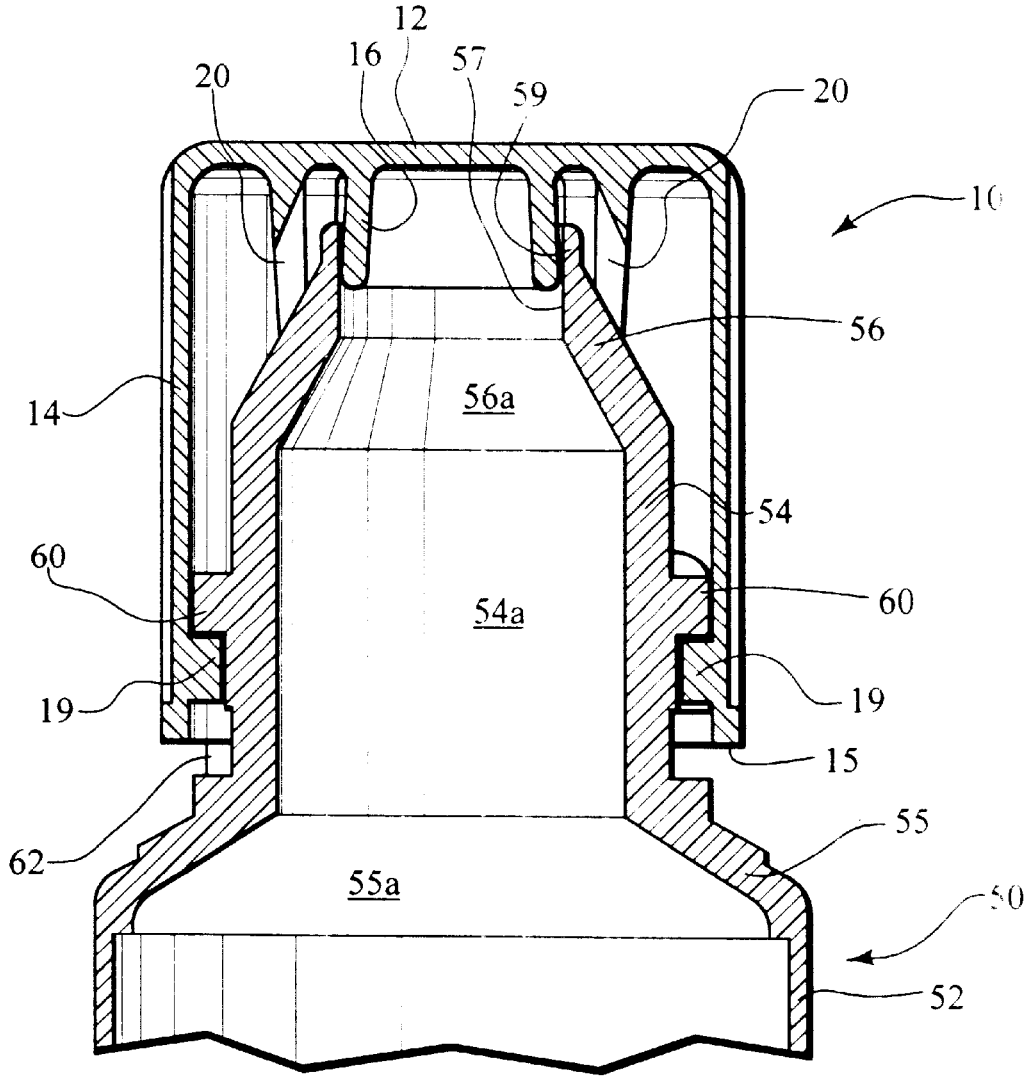
FIG. 9 is a section view of the safety closure of FIG. 1 shown affixed to the container neck portion of FIG. 1, and shown along section line 9—9 of FIG. 8.

With additional reference to FIGS. 8 and 9, the safety closure 10 is affixed to the container 50 (and particularly, to the container neck portion 54) by aligning the safety closure 10 with the container neck portion 54 such that the lugs 19 are aligned with their respective lug-receiving recesses 64. The safety closure 10 is then depressed axially downwardly onto the container neck portion 54 such that each lug-receiving recess 64 receives their respective lug 19 therein. The safety closure 10 is then simultaneously moved axially downwardly and radially forwardly (that is, clockwise, when viewed from above) such that the lugs 19 simultaneously travel within their respective lug-receiving recesses 64 and into their respective lower recesses 62. At this point, the annular plug 16 has been received downwardly into the orifice 57 of the upturned portion 59 and thereby forms a sealing fit with an inner annular surface of the upturned portion 59 and with an inner annular surface of the camming portion passageway 62*a*, which may be provided with a slight inward radial taper downwardly away from the orifice 57 to prevent the plug 16 from becoming stuck therein.

The spring members 20 depend downwardly from the end wall 12 a sufficient distance (and the lugs 19 are spaced from the end wall 12 a sufficient distance) such that, as the lugs 19 travel downwardly within their respective lug-receiving recesses 64 and into their respective lower recesses 62, the spring members 20 abut an outer surface of the camming portion 56 and are flexed radially outwardly thereby against their natural resilience to remain in a substantially-downward orientation. The camming portion 56 thereby provides an axially-upward biasing force to the safety closure 10, biasing the lugs 19 upwardly and outwardly of their respective lug-receiving recesses 64 along an angled upper rail 74*a* thereof define by the latch portion 74. The user prevents unwanted lifting and removal of the safety closure 10 from the container neck portion 54 by continuing to apply a downward axial force to the safety closure 10 against the upward bias of the spring members 20 at all times during which the lugs 19 are positioned in the lug-receiving recesses 64. If the user removes the downward axial force from the safety closure 10 while the lugs 19 are positioned within the lug-receiving recesses 64, the upward biasing force will lift the lugs 19 away from annular band 60*a* until the lugs 19 abut the upper rails 74*a*, at which point the upward biasing force will cause the lugs 19 to slide along the rails 74*a* upwardly and backwardly, forcing the safety closure 10 off of the container 50.

However, once the safety closure 10 has been depressed downwardly a sufficient axial distance such that the lugs 19 are positioned within their respective lower recesses 62, the safety closure 10 is rotated forwardly a preselected distance such that the lugs 19 are positioned axially downwardly adjacent their respective lower recess upright portions 63. In response to the user's removing the downward axial force from the safety closure 10, the upward biasing force provided by the spring members 20 lifts the lugs 19 axially upwardly away from the annular band 60*a* and seats the lugs 19 within their respective lower recess upright portions 63. Removal rotation of the safety closure 10 is thereby prevented while the lugs 19 are seated within their respective lower recess upright portions 63 by an abutment 69 defined by the latch portion 74 of the bayonet 60.

Removal of the safety closure 10 from the container 50 is accomplished by depressing the safety closure 10 downwardly against the upward biasing force provided by the spring members 20 a sufficient distance to unseat the lugs 19 from within the lower recess upright portions 63 and to position the lugs 19 within their respective lower recesses 62. The safety closure 10 is then rotated backwardly a sufficient distance such that the lugs 19 are no longer positioned axially downwardly from their respective lower recess upright portions 63, but are instead positioned axially downwardly from their respective lug-receiving recesses 64 and downwardly adjacent the angled rails 74*a* thereof. The user's releasing the downward force opposing the spring member biasing force lifts the safety closure 10 axially upwardly relative to the container 50, thereby positioning the lugs 19 within their respective lug-receiving recesses 64 and to travel upwardly therein along the angled lower rails 74*a* and off of the container neck portion 54.

The engagement of the annular plug 16 with the inner surface of the camming portion 56 provides an efficient, fluid-impervious seal therebetween which is not substantially negatively affected by flexure of the spring members 20 against the container neck camming portion 56. Because the spring members 20 are separate from the annular plug 16, the annular plug 16 does not need to flex to provide a biasing force, thereby maintaining the sealing fit between the annular plug 16 and the container neck portion 54 during affixing and removing the safety closure 10 therefrom.

Figure 10:
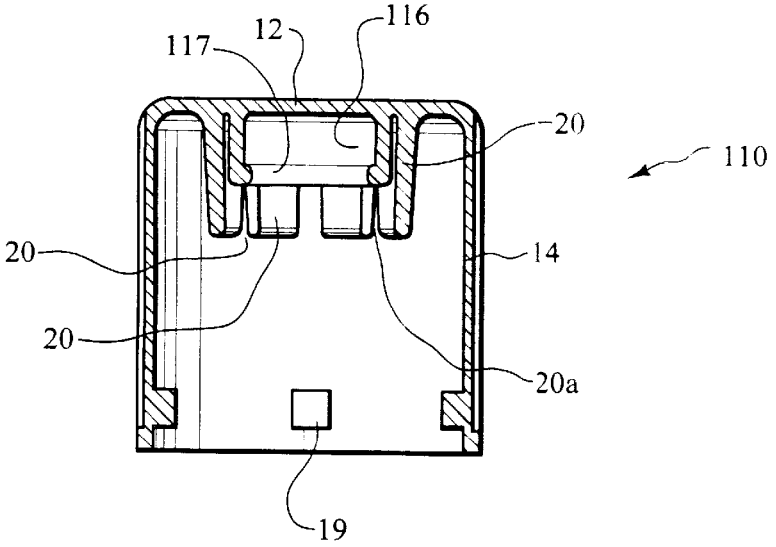
FIG. 10 is a section view of a safety closure according to an alternative embodiment of the present invention.
Figure 11:
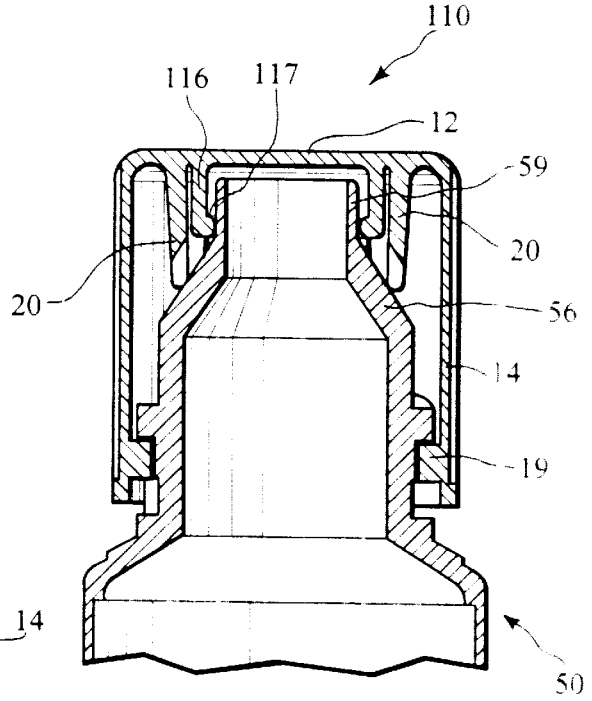
FIG. 11 is a section view of the safety closure of FIG. 10 shown affixed to the container neck portion of FIG. 1.
Figure 12:
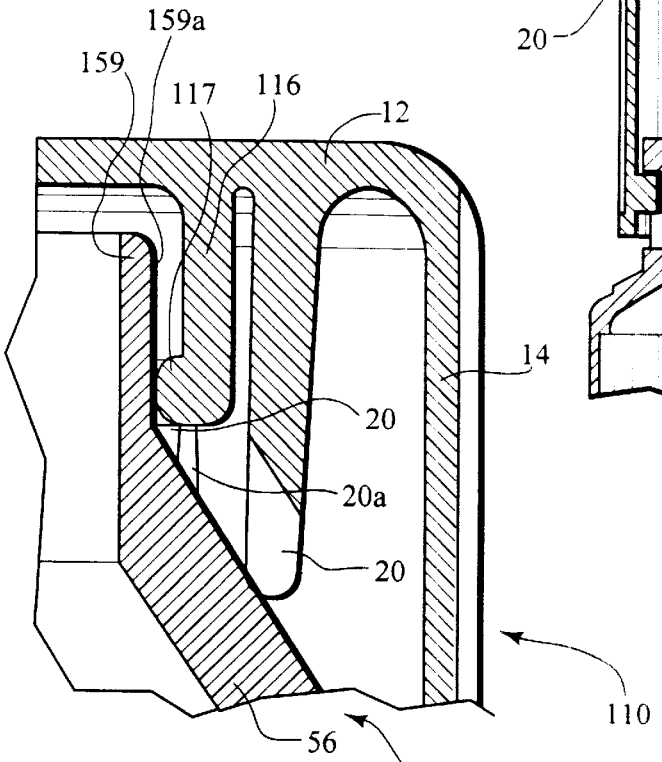
FIG. 12 is a detail section view of a sealing region of the safety closure of FIG. 10 shown affixed to the container neck portion of FIG. 1.

With reference to FIGS. 10–12, a safety closure 110 according to an alternative embodiment of the present invention is shown affixed to the container 50 according to the preferred embodiment hereof hereinabove described, wherein the safety closure 110 according to the present embodiment includes many components in common with the safety closure 10 according to the preferred embodiment hereof hereinabove described, and wherein like reference numerals are intended to represent like components. However, the container 50 further includes an extended upturned cylindrical portion 159 having an outer sealing surface 159*a* which is sized to sealingly engage a continuous sealing bead 117 projecting radially inwardly from a lower end of a continuous sealing collar 116 provided on the safety closure 110. According to the present embodiment, the sealing collar 116 depends downwardly from the top wall 12 of the safety closure 110, is positioned radially inwardly from the plurality of spring members 20 and is spaced circumferentially therearound. The spring members 20 are permitted to flex as necessary to provide the aforementioned upward biasing force without more than nominally affecting the sealing engagement between the sealing bead 117 and the outer surface 159*a* of the container extended upturned cylindrical portion 159.

Figure 13:
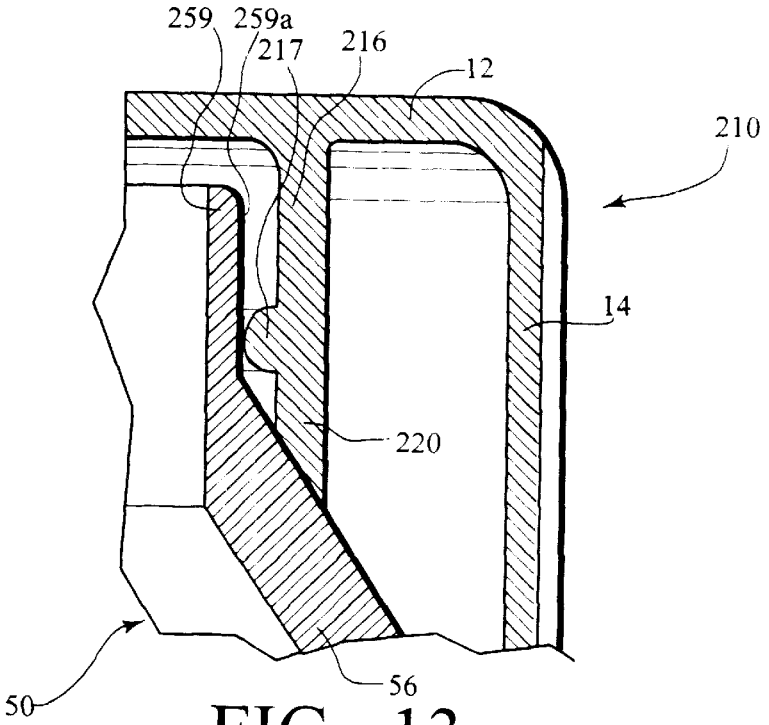
FIG. 13 is a detail section view of a sealing region of a safety closure according to another alternative embodiment of the present invention shown affixed to the container neck portion of FIG. 1.

With reference to FIG. 13, a safety closure 210 according to another alternative embodiment of the present invention is shown affixed to the container 50 according to the preferred embodiment hereof hereinabove described, wherein the safety closure 210 according to the present embodiment includes many components in common with the safety closure 10 according to the preferred embodiment hereof hereinabove described, and wherein like reference numerals are intended to represent like components. However, the container 50 further includes an extended upturned cylindrical portion 259 having an outer sealing surface 259*a* which is sized to sealingly engage a continuous sealing bead 217 projecting radially inwardly from a lower end of a continuous sealing collar 216 provided on the safety closure 210. Preferably, the sealing collar 216 depends downwardly from the top wall 12 of the safety closure 210. The plurality of spring members 220 depend downwardly from a lower end of the sealing collar 216 and are spaced circumferentially therearound. The spring members 220 are permitted to flex as necessary to provide the aforementioned upward biasing force without more than nominally affecting the sealing engagement between the sealing bead 217 and the outer surface 259*a* of the container extended upturned cylindrical portion 259.

Figure 14:
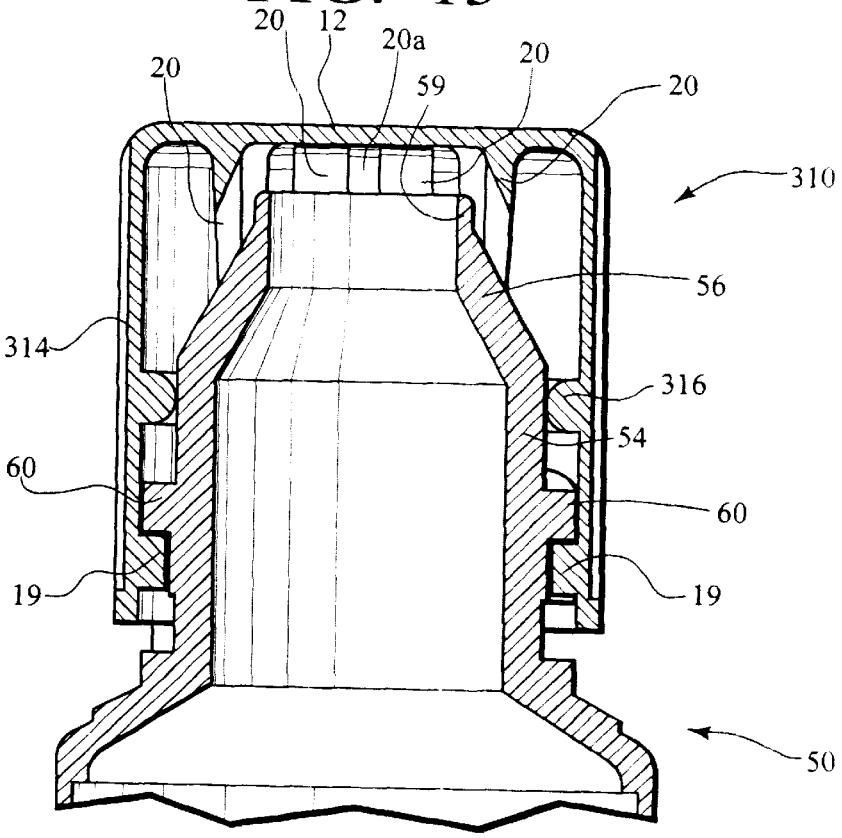
FIG. 14 is a section view of a safety closure according to another embodiment of the present invention shown affixed to the container neck portion of FIG. 1; and, FIG. 15 is a section view of a safety closure according to another embodiment of the present invention shown affixed to a container neck portion according to another embodiment of the present invention.

With reference to FIG. 14, a safety closure 310 according to another alternative embodiment of the present invention is shown affixed to the container 50 according to the preferred embodiment hereof hereinabove described, wherein the safety closure 310 according to the present embodiment includes many components in common with the safety closure 10 according to the preferred embodiment hereof hereinabove described, and wherein like reference numerals are intended to represent like components. However, the safety closure 310 according to the present embodiment includes a sealing bead 316 projecting inwardly from an inner surface of the cylindrical skirt 314 which is size to sealing engage an outer surface of the container neck portion 54. According to the present embodiment, the sealing bead 314 is positioned axially above the at least one lug 19, although the sealing bead 314 may be positioned at any axial position along the cylindrical skirt 314 which permits sealing engagement with a portion of the container neck portion 54. The spring members 20 are permitted to flex as necessary to provide the aforementioned upward biasing force without more than nominally affecting the sealing engagement between the sealing bead 316 and the outer surface of the container neck portion 54.

Figure 15:
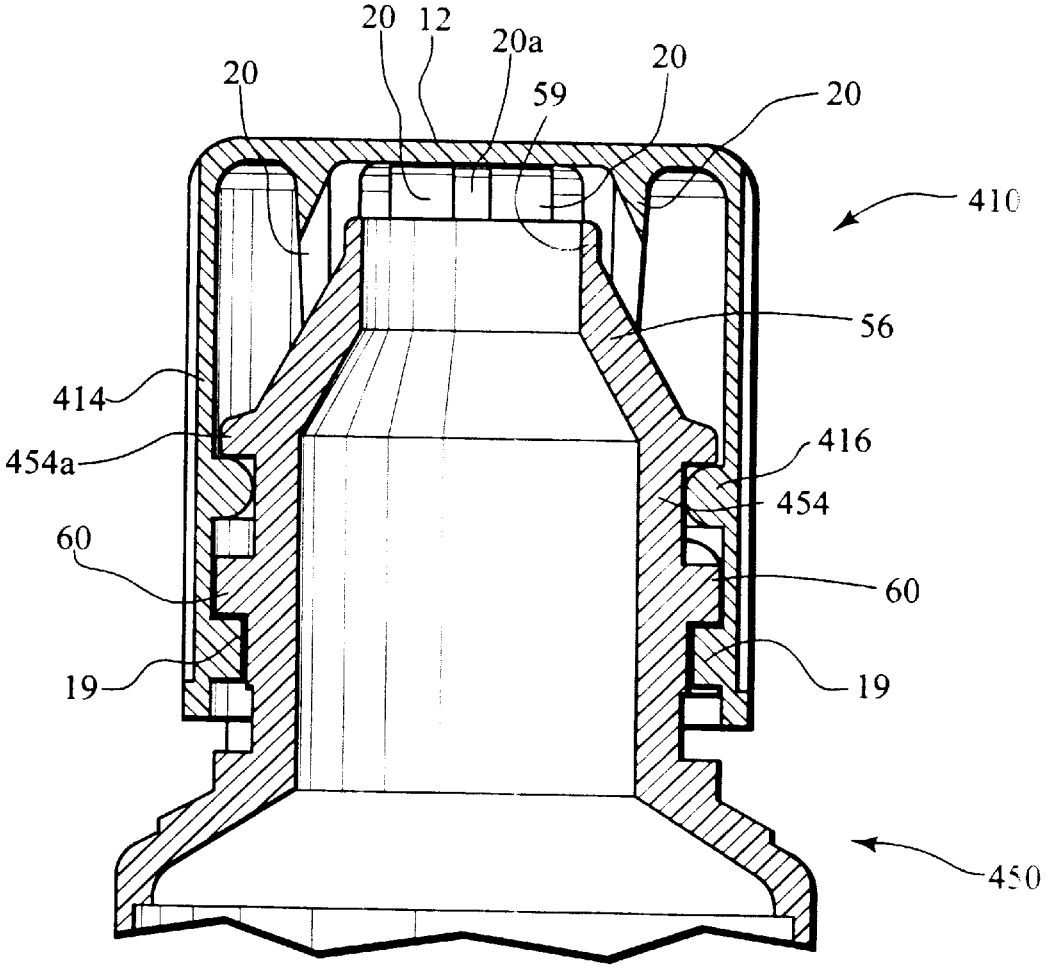

With reference to FIG. 15, a safety closure 410 according to another alternative embodiment of the present invention is shown affixed to a container 450 according to the present embodiment hereof, wherein the safety closure 410 and container 450 according to the present embodiment includes many components in common with the safety closure 10 and container 50 according to the preferred embodiment hereof hereinabove described, and wherein like reference numerals are intended to represent like components. However, the safety closure 410 according to the present embodiment includes a first sealing bead 416 projecting inwardly from an inner surface of the cylindrical skirt 414 which is size to sealing engage a second sealing bead 454*a* projecting outwardly from an outer surface of the container neck portion 454. According to the present embodiment, the first sealing bead 414 is positioned axially above the at least one lug 19, although the first sealing bead 414 may be positioned at any axial position along the cylindrical skirt 414 which permits sealing engagement with the second sealing bead 454*a* of the container neck portion 454. The spring members 20 are permitted to flex as necessary to provide the aforementioned upward biasing force without more than nominally affecting the sealing engagement between the first sealing bead 416 and the container neck portion 454 second sealing bead 454*a*.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

What is claimed is:

1. A safety closure and a container, comprising:

a container neck on a container, said container neck having an upstanding wall, said upstanding wall having a plurality of lug-receiving recesses therein, said container neck further having a dispensing orifice having an upper vertical inner surface and a camming portion on an exterior wall of said container neck, said camming portion being a frusto-conical surface disposed between said dispensing orifice and said upstanding wall, said lug receiving recesses spaced from and below said camming portion on said container neck;

said safety closure having an end wall, and a depending annular side wall, said side wall having a plurality of lugs projecting therefrom, said lugs being engageable with said lug-recciving recesses of said container neck, continuous annular sealing element depending from said end wall and being sealingly engageable with said container neck, and a plurality of spring members being resiliently engageable with said camming portion to bias said safety closure away from said container neck, said plurality of spring members spaced outwardly from said sealing element;

said sealing element engaging said vertical inner surface of said dispensing orifice.

2. A safety closure and a container, comprising:

a container neck on a container, said container neck having a plurality of lug-receiving recesses therein and terminating at an upturned cylindrical portion, a dispensing orifice and a camming portion on an exterior wall of said container neck, said camming portion forming a frusto-conical surface disposed between said plurality of lug receiving recesses and said upturned cylindrical portion;

said safety closure having an end wall, and a depending annular side wall, said side wall having a plurality of lags projecting therefrom, said lugs being engageable with said lug-receiving recesses of said container neck, a continuous annular sealing element depending from said end wall and being sealingly engageable with said container neck portion, and a plurality of spring members being resiliently engageable with said camming portion to bias said safety closure away from said container neck, said plurality of spring members spaced outwardly from said sealing element;

wherein said sealing element engages an inner surface of sad dispensing orifice adjacent said upturned cylindrical portion.

3. A safety closure and a container, comprising:

a container neck portion on said container, said container neck portion having at least one lug-receiving recess therein;

a dispensing orifice and a camming portion on an exterior wall of said container neck portion;

said lug-receiving recess spaced from and below said camming portion on said container beck portion;

said safety closure having an end wall, a side wall depending from said end wall, said side wall having at least one lag projecting therefrom, said at least one lug being engageable with said at least one lug receiving recess of said container neck portion, a sealing element depending from said end wall and being sealingly engageable with an outer surface of said container neck portion said sealing element including a sleeve portion depending from said end wall and a sealing bead projecting inwardly from said sleeve; and at least one spring member being resiliently engageable with said camming portion to bias said safety closure away from said container neck portion;

said at least one spring member spaced outwardly from said sealing element.

4. The safety closure of claim 3, said at least one lug being moveable within said at least one lug-receiving recess between a first position and a second position, said safety closure being removable form said container neck portion when said at least one lug is in said first position.

5. The safety closure of claim 4, said at least one spring member biasing said at least one lug towards a third position of said at least one lug when said at least one lug is in said second position, said at least one lug being seated within an upturned portion of said at least one lug-receiving recess when said at least one lug is in said third position.

6. The safety closure of claim 3, said at least one lug including four lugs being equidistantly spaced around said side wall.

7. The safety closure of claim 3, wherein said camming portion of said container neck portion includes a frusto-conical portion thereof on said exterior of said neck and further wherein said container neck portion includes an upright portion which contacts said sealing element.

8. The safety closure of claim 3, said sealing element engaging an inner surface of said dispensing orifice.

9. A safety closure and container combination, comprising:

a container having a body portion and neck portion, said body portion defining a cavity therein, said neck portion having a dispensing orifice in an upper end thereof; said dispensing orifice communicating with said cavity through a passageway in said neck portion, said neck portion having at least one lug-receiving recess therein and a camming portion on an exterior wall of said neck portion, said lug receiving recess spaced from and below said camming portion;

a safety closure having an end wall, a side wall depending from said end wall, said side wall having at least one lug projecting therefrom, said at least one lug being engageable with said at least one lug-receiving recess in said container neck portion, a sealing element depending downward from said end wall and being sealingly engageable with said container neck portion said sealing element comprising a sealing bead, said sealing bend extending inwardly and engaging an outer surface of said container neck portion, said at least one spring member being resiliently engageable with said camming portion on said container neck to bias said safety closure away from said container neck portion, said at least one spring member spaced outwardly from said sealing element.

10. The safety closure and container combination of claim 9, said at least one lug-receiving recess being defined by at least one bayonet projecting outwardly from said container neck portion, said at least one lug being moveable within said at least one lug-receiving recess between a first position and a second position, said safety closure being removable from said container neck portion when said at lest one lug is in said first position.

11. The safety closure and container combination of claim 10, said at least one spring member biasing said at least one lug towards a third position of said at least one lug when said at least one lug is in said second position.

12. The safety closure and container combination of claim 11, said at least one bayonet including an upright portion, an overhead portion and a latch portion, said upright portion said overhead portion and said latch portion defining an upturned portion of said at least one lug-receiving recess, said at least one lug being seated within said upturned portion when said at least one lug is in said third position.

13. The safety closure and container combination of claim 9, said at least one lug including four lugs being equidistantly spaced around said side wall.

14. The safety closure amid container combination of claim 9, said at least one spring member being comprised of a plurality of spring members, each of said plurality of spring members resiliently engageable with said camming portion.

15. The safety closure and container combination of claim 9, said sealing element engaging an inner surface of said dispensing orifice.

16. A safety closure and container, comprising:

a container neck portion on said container, said container neck portion having a plurality of lug-receiving recesses therein, a dispensing orifice, a camming portion therebetween and formed on an exterior wall of said container neck portion and an upstanding cylindrical portion extending upwards from said camming portion;

said safety closure having:

an end wall;

a side wall depending front said end wail, said side wall having a plurality of lugs projecting therefrom, said plurality of lugs being engageable with said plurality of lug-receiving receiving of said container neck portion;

at least one spring member being resiliently engageable with said camming portion to bias said safety closure away from said container neck portion;

a sealing element depending downward form said end wall and being sealingly engageable with said container neck portion, said sealing element comprising a sealing bead, said sealing bead engaging an exterior surface of said upstanding cylindrical portion;

said at least one spring member depending from said closure end wall.

17. The closure and container of claim 16 wherein said at least one spring member is comprised of a plurality of spring members which are spaced outwardly from said sealing element.

18. A safety closure and a container, comprising:

a container neck on a container, said container neck having a lower upstanding wall and a frusto-conical camming surface terminating at a dispensing oriface, said lower upstanding wall having a plurality of lug recesses thereon, said frusto-conical camming surface disposed between said dispensing oriface and said lower upstanding wall on said container neck;

a safety closure having an end wall and a depending annular side wall, said side wall heaving a plurality of lugs projecting inwardly therefrom, said lugs adapted to engage said lug receiving recesses of said lower upstanding wall on said container neck;

an annular sealing element depending from said end wall and being engageable on an interior wall of said container neck at said dispensing oriface;

plurality of spring members engageable with said camming surface axially biasing said safety closure away from said dispensing oriface, said plurality of spring members spaced outwardly from said sealing element and towards said side wall.

* * * * *

UNITED STATES PATENT AND TRADEMARK OFFICE

CERTIFICATE OF CORRECTION

PATENT NO. : 6,378,713 B2
DATED : April 30, 2002
INVENTOR(S) : Gary V. Montgomery It is certified that error appears in the above-identified patent and that said Letters Patent is hereby corrected as shown below:

Column 8,
Line 49, change "beck" to -- neck --;
Line 52, change "lag" to -- lug --;

Column 9,
Line 1, change "form" to -- from --;
Line 38, change "bend" to -- bead --;

Column 10,
Line 4, change "amid" to -- and --;
Line 25, change the second occurrence of "receiving" to -- recesses --;
Line 57, before "plurality" insert -- a --.

Signed and Sealed this

Fourth Day of February, 2003

JAMES E. ROGAN
*Director of the United States Patent and Trademark Office*